US005988134A

United States Patent [19]

Smietanski

[11] Patent Number: 5,988,134

[45] Date of Patent: Nov. 23, 1999

[54] TWO PIECE LOCKING OIL PICKUP TUBE ASSEMBLY

[75] Inventor: Richard A. Smietanski, Lockport, Ill.

[73] Assignee: Navistar International Transportation Corp, Chicago, Ill.

[21] Appl. No.: 08/604,067

[22] Filed: Feb. 20, 1996

[51] Int. Cl.[6] ..... F01M 1/00

[52] U.S. Cl. ..... 123/196 R; 123/195 C

[58] Field of Search ..... 123/196 R, 195 C; 184/106

[56] References Cited

U.S. PATENT DOCUMENTS

| | | | |
|---|---|---|---|
| 4,616,610 | 10/1986 | Ishida | 123/196 A |
| 4,770,276 | 9/1988 | Takubo | 184/106 |
| 4,825,825 | 5/1989 | Chino et al. | 123/195 C |
| 5,014,659 | 5/1991 | Ohshima et al. | 123/195 H |
| 5,161,642 | 11/1992 | Murakana | 184/6.5 |
| 5,653,205 | 8/1997 | Ozeki | 123/195 C |

*Primary Examiner*—Noah P. Kamen
*Assistant Examiner*—Hai Huynh
*Attorney, Agent, or Firm*—Dennis Kelly Sullivan; Jeffrey P. Calfa

[57] ABSTRACT

An oil pickup tube assembly for an internal combustion engine comprises a two-piece structure including a base member which attaches to an oil intake or inlet of an engine and includes an elbow therein permitting angling the inlet end of the pickup member into the appropriate position within a sump area of the oil pan. The pickup member comprises a U-shaped tube, one end of which engages the base member and another end of which depends into the sump area, with the inlet end being supported by a bracket attached to the crankcase. The interface between the tube and the base member includes an O-ring seal, with the tube and base member being releasably locked together by relative rotation therebetween and a tab and slot engagement formed between the pieces to permit a certain amount of stress-free misalignment between the base member and the pickup member.

8 Claims, 4 Drawing Sheets

TWO PIECE LOCKING OIL PICKUP TUBE ASSEMBLY

BACKGROUND OF THE INVENTION

The present invention relates to a lubricating oil pickup tube assembly for an internal combustion engine. More specifically, the pickup tube comprises two pieces which may be locked together by relative rotation to provide a flexible but sealed joint, thereby facilitating stress-free assembly of the pickup tube in the engine oil pan.

THE PRIOR ART

Heretofore, a typical engine oil pickup tube has been a rigid assembly comprising an inlet elbow casting with a tube brazed thereto. The inlet elbow is bolted to the oil pump inlet of the engine near the top of the oil pan and the tube extends therefrom and curves downwardly to a suction end which is located near the bottom of the oil pan whereat it is held in place by a support bracket rigidly attached thereto and suspended from the bottom surface of the engine crankcase.

Problems have been encountered because placement of the support bracket on its mounting holes as well as placement against the engine oil intake must be precise, oftentimes requiring much physical torquing to be applied against the tube to obtain desired alignment. Such torquing has led to damage of the tube. Further, if exact alignment is not achieved between the tube and the intake significant oil leakage from the area of joining can be incurred.

SUMMARY OF THE INVENTION

Accordingly, it is a primary object of the invention to provide an oil pickup tube assembly which is easily mounted in place and which can be manually manipulated into proper positioning without leakage potential being developed therein.

This and other objects are specifically met by the oil pickup tube assembly of the present invention which comprises a two piece assembly having a flexible joint therebetween, one piece being the inlet elbow including an end portion having a cylindrical inner periphery and the other being a tube which slidingly engages within the end portion, an O-ring seal being disposed therebetween, and which is locked in position within the end portion of inlet elbow by relative rotary motion therebetween.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
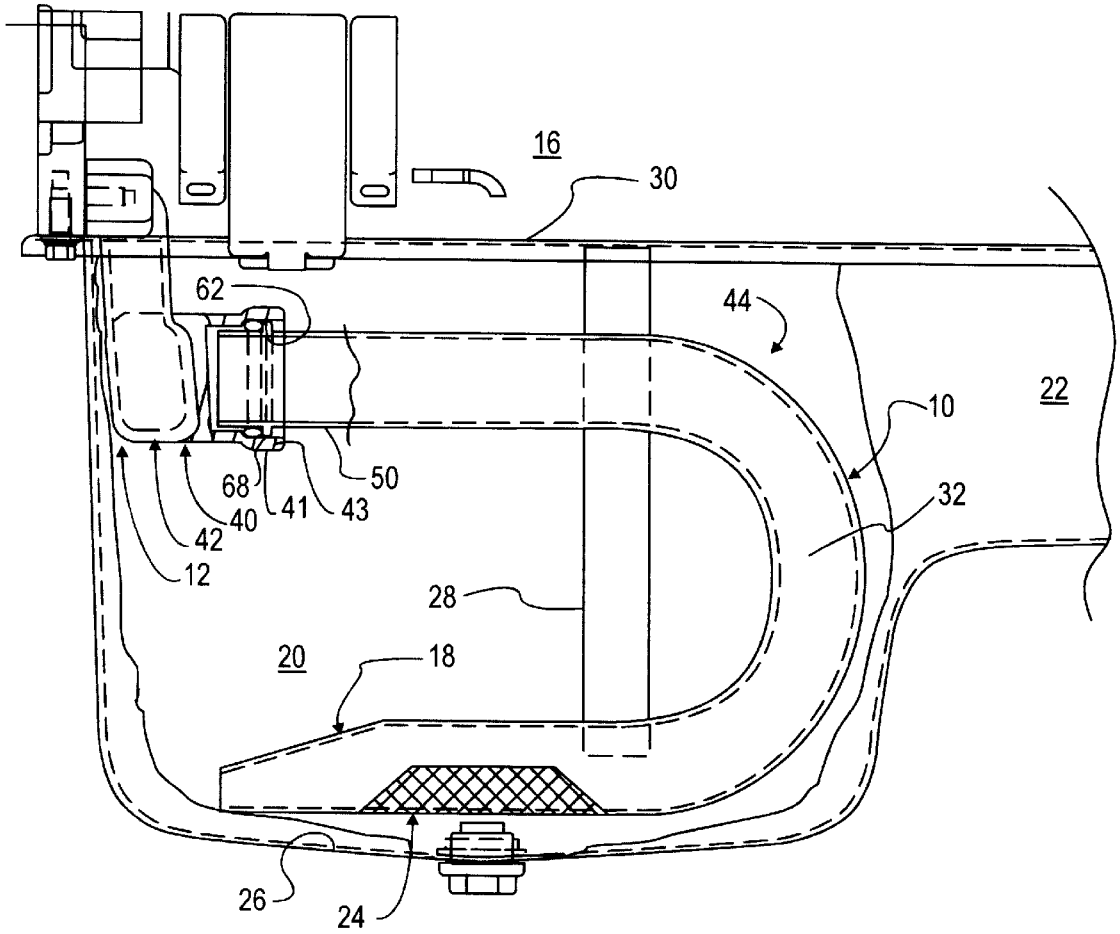
FIG. 1 is a side view partly in section of the sump area of an oil pan with portions of the side wall of the oil pan cut away an engine crankcase shown thereabove and shows the pickup tube assembly of the present invention engaged to the crankcase and extending into the oil pan.
Figure 2:
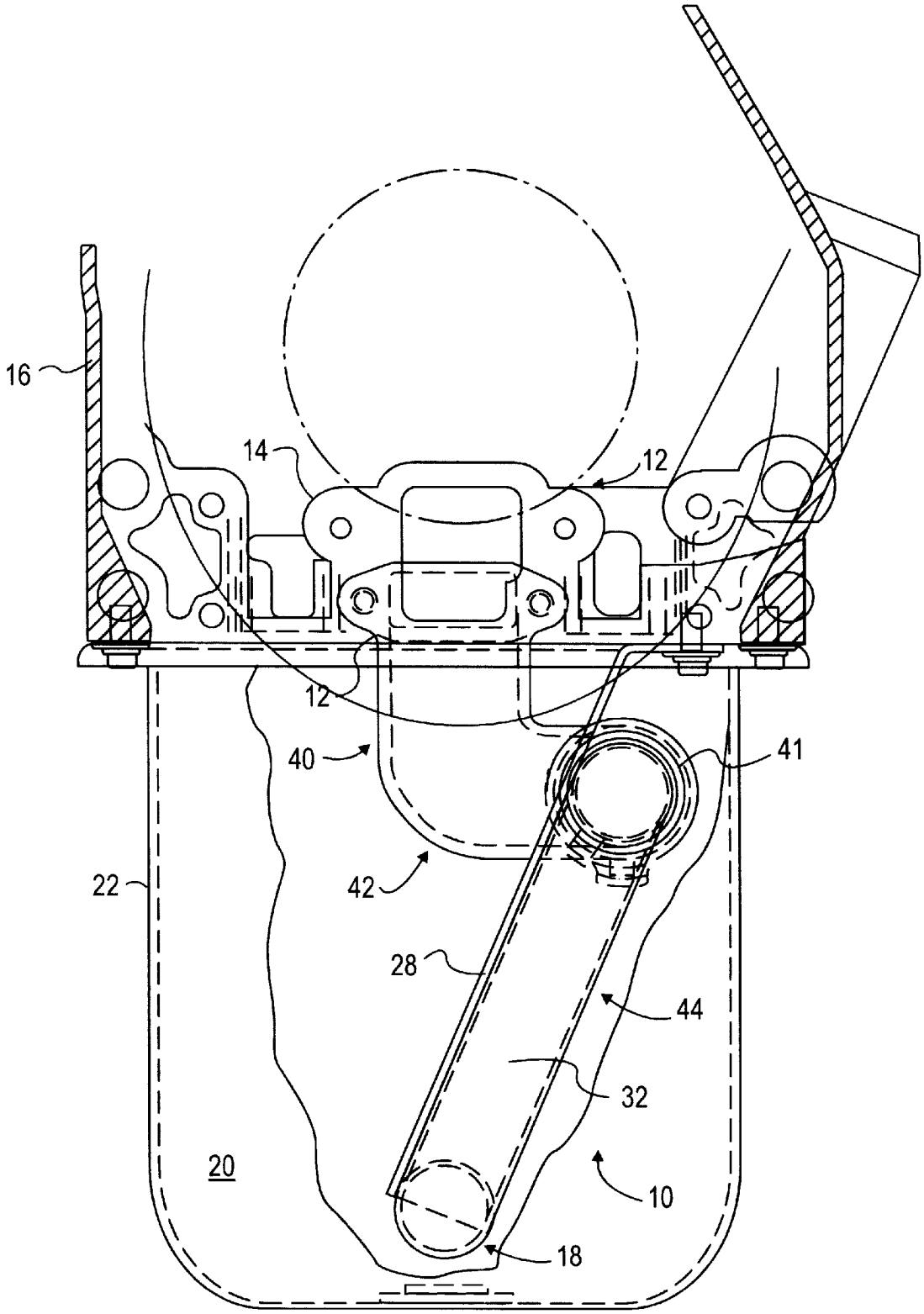
FIG. 2 is an end view into an oil pan sump area and shows the pickup tube assembly therein.

Referring now to the drawings in greater detail there is illustrated therein the two-piece oil pickup tube assembly of the present invention generally identified by the reference numeral 10.

As shown, the pickup tube assembly 10 has a flanged outlet 12 which engages an oil intake passage 14 of the engine 16 leading to the lubricating oil pump (not shown). The pickup tube assembly 10 has an inlet or suction end 18 which rests within a sump area 20 of an oil pan 22. The inlet end 18 has a screened inlet 24 therein which faces downwardly into the sump area 20 and is located at a predetermined height above a bottom surface 26 of the sump area 20, its relative position being maintained by a bracket 28 which engages to a mounting boss 30 on the lower face of the engine crankcase 16. The tube has a curved portion 32 between the ends 12 and 18.

It can be seen that if the pickup tube assembly were a one piece rigid tube assembly, as in the prior art, a significant amount of force could be required to accommodate obtaining a sealed bolted-flange connection at the tube outlet while having the suction end 18 properly positioned centrally above the lowest portion of the sump 20 and the bracket 28 properly positioned relative to the mounting boss 30 of the crankcase, especially with the variance in tolerances which could exist with a curved tube, and with the two brazed or welded joints between the tube and the inlet elbow and between the tube and the elbow. The pickup tube assembly 10 provides for a certain amount of flexibility between the inlet elbow and the tube and thus can accommodate tolerance variation without resulting in built-in assembly stresses on the tube assembly.

As shown, the pickup tube assembly 10 comprises a two piece unit having a flexible joint interface therebetween, the first piece comprising an inlet member 40 incorporating the flanged outlet 12 which engages to and feeds the engine oil intake 14. The inlet member 40 incorporates an elbow 42 therein which extends into the oil pan 22 to a distal end 41 having a slightly enlarged end having a cylindrical inner wall 43 formed therein and within which the second piece, a U-shaped tube 44 of smaller diameter than the inner wall 43, is slidingly engaged. The U-shaped tube 44 extends across the sump area 20 at the level of the elbow 42 and then doubles back under itself to place the tube inlet 24 at the appropriate level just above the bottom surface 26 of the sump area 20. The curved area 32 defining the base of the U is supported by the bracket 28 to position it appropriately for proper positioning of the inlet 24 of the tube 44.

When the two pieces 40 and 44 are joined together in a manner to not only accommodate engagement between the inlet member 40 and the engine oil inlet 14 but also to accommodate appropriate positioning of the tube inlet 24, a less than ideal interface between an end 50 of the U-shaped pickup tube 44 and the elbow 42 may be incurred for the reasons discussed above. Such less than ideal interface may be a site of oil leakage unless the relative position of the inlet member 40 and tube 44 are accommodated by the flexible joint between the pieces 40 and 44 together to be defined which joint must be locked to prevent the possibility of the pieces separating from each other during the life of the engine.

Figure 4:
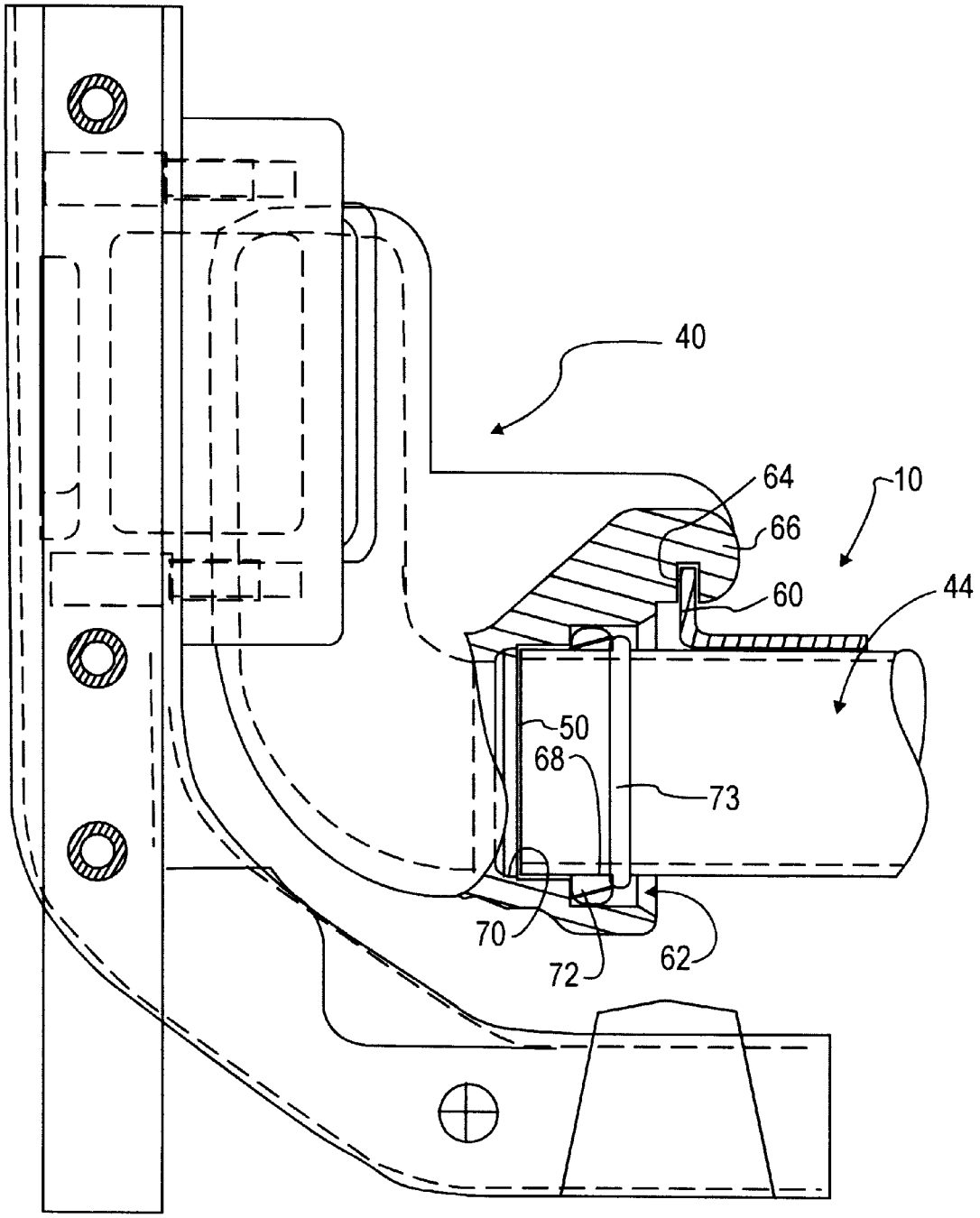

It will be seen from FIG. 4 that the end 50 of the U-shaped tube 44 to be engaged to the elbow 42 of the base member 40 is provided with a locking tab 60 extending radially outwardly from the circumference of the tube 44 at a predetermined distance from the end 50. Cooperating with this tab 60 is a slot 64 of predetermined width and predetermined limited circumferential extent which is formed within a flange 66 located at a suitable position on the base member 40 adjacent the opening 62. This tab 60 and slot 64 arrangement maintains the connection of the aligned base member 40 and tube 44, such alignment being conditional upon the position at which the U-shaped end 32 of the tube 44 is supported by the bracket 28.

Thus, the engagement of the tab 60 within the slot 64 will accommodate both required alignments at once, with the width of the slot 64 determining the extent of tolerated misalignment in the longitudinal direction of the joint while the rotational position of the tab in the slot accommodates misalignment in the lateral direction.

To assure that there is no possibility of leakage at the interface between the tube 44 and inlet member 40 a shoulder 68 is formed on the inner wall 43 of the inlet member 40 which defines the opening 62. An O-ring 72 seats between the tube 44 and the wall 40 within the opening 62 and against the shoulder 68. The joining end 50 of the tube 44 includes a circumferential rib 73 which is positioned adjacent the end 50 of the tube 44 in a manner to be drawn up against the O-ring 72 by engagement of the tab 60 within the confines of the slot 64.

Figure 3:
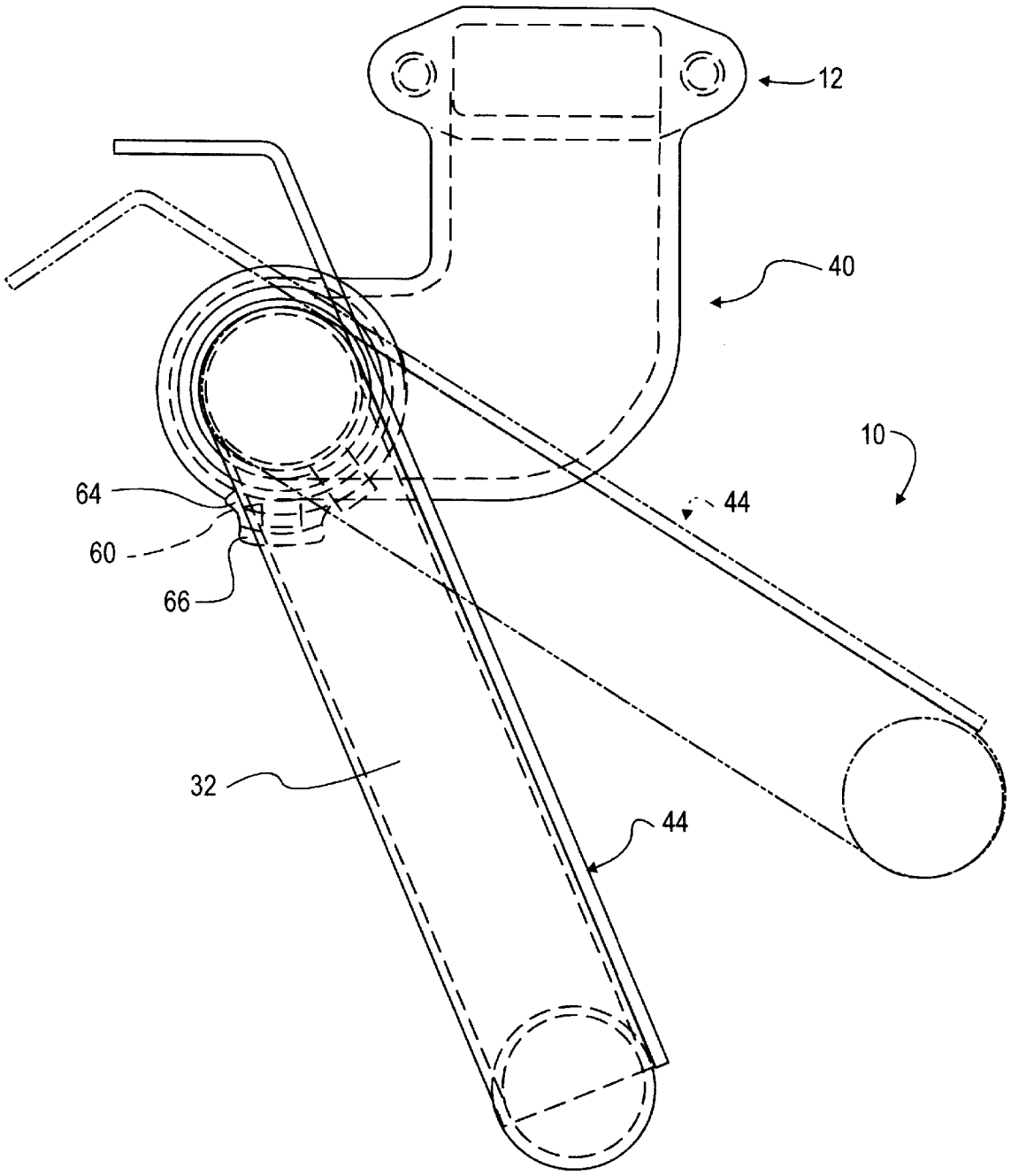
FIG. 3 is an end view of the pickup tube assembly showing the relative movement between the pieces thereof during assembly; and, FIG. 4 shows an alternative embodiment of the locking device of FIGS. 1–3.

In use, as best shown in FIG. 3, the end 50 of the tube 44 is pushed into the opening 62 in the inlet member 40 with the tab 60 being placed to one side of the flange 66. The tube 44 is then rotated slightly to engage the tab 60 within the slot 64 in the flange 66 and lock the inlet member 40 and tube 44 together. Once this engagement is formed, the U-shaped area 32 of the tube 44 is hung by the bracket 28 to place the inlet 24 of the tube 44 at an appropriate position within the sump area 20 of the oil pan 22 which is then engaged thereover while the upper end of the bracket is bolted to the crankcase boss 30.

As described above, the oil pickup tube assembly of the present invention provides a number of advantages some of which have been described above and others of which are inherent in the invention. Also, modifications may be proposed to the pickup tube assembly without departing from the teachings herein. For example, the slot 64 could be placed in the wall 43 of the inlet member 40 together with an axial groove to receive a repositioned locking tab 60 on the tube 44, provided the slot is not in the sealing area. Accordingly, the scope of the invention is only to be limited as necessitated by the accompanying claims.

What is claimed is:

1. In combination with an internal combustion engine having a crankcase, an oil pump inlet, and an oil pan secured to said crankcase, said oil pan including a sump, a two-piece oil pickup tube assembly comprising a tubular base member engaged to said oil inlet and having an intake end, and a tubular pickup member having an inlet end disposed within said engine oil pan sump and an outlet end slidingly engaged with said intake end of said base member and forming an interface therewith permitting relative movement therebetween, means for sealing said interface, and locking means for retaining said base member and said pickup member in engagement during engine operation.

2. The invention of claim 1 said pickup member is secured to said crankcase.

3. In combination with an internal combustion engine having crankcase, an oil pump inlet, and an oil pan secured to said crankcase, said oil pan including a sump, a two-piece oil pickup tube assembly comprising a tubular base member engaged to said oil inlet and having an intake end, and a tubular pickup member having an inlet end disposed within said engine oil pan sump and an outlet end slidingly engaged with said intake end of said base member to form an interface permitting relative movement therebetween, means for sealing said interface, and locking means for retaining said base member and said pickup member in engagement wherein said pickup member is supported adjacent the inlet end thereof by a bracket which depends from said crankcase of the engine to hold said inlet end of said pickup member at a desired height above a bottom surface of the oil pan sump.

4. In combination with an internal combustion engine having a crankcase, an oil pump inlet, and an oil pan secured to said crankcase, said oil pan including a sump, a two-piece oil pickup tube assembly comprising a tubular base member engaged to said oil inlet and having an intake end, and a tubular pickup member having an inlet end disposed within said engine oil pan sump and an outlet end slidingly engaged with said intake end of said base member to form an interface permitting relative movement therebetween, means for sealing said interface, and locking means for retaining said base member and said pickup member in engagement wherein said locking means comprises a radial flange on said base member which includes a slot therein and a radial tab disposed on said pickup member cooperate with and engage within the flange slot on the base member.

5. The invention of claim 4 wherein said tab is engageable within said slot by relative rotation between the base member and the tube.

6. The invention of claim 5 wherein the slot is provided with a predetermined width which defines the extent of misalignment tolerated between the members.

7. In combination with an internal combustion engine having a crankcase, an oil sump inlet, and an oil pan secured to said crankcase, said oil pan including a sump, a two-piece oil pickup tube assembly comprising a tubular base member engaged to said oil inlet and having an intake end, and a tubular pickup member having an inlet end disposed within said engine oil pan sump and an outlet end slidingly engaged with said intake end of said base member to form an interface permitting relative movement therebetween, means for sealing said interface, and locking means for retaining said base member and said pickup member in engagement wherein said sealing means comprises an interior shoulder provided in the base member intake end against which an O-ring seal is compressed by the outlet end of the pickup member.

8. The invention of claim 7 wherein said outlet end of said pickup member further includes an external circumferential rib thereon which is positioned to compress said O-ring against the base member.

* * * * *